US007971582B1

(12) United States Patent
Larson

(10) Patent No.: US 7,971,582 B1
(45) Date of Patent: Jul. 5, 2011

(54) PULLEY ASSEMBLY AND AXLE FOR COMPOUND BOWS

(75) Inventor: Marlow W. Larson, Ogden, UT (US)

(73) Assignee: Larson Archery Company, Ogden, UT (US)

( * ) Notice: Subject to any disclaimer, the term of this patent is extended or adjusted under 35 U.S.C. 154(b) by 600 days.

(21) Appl. No.: 12/074,930

(22) Filed: Mar. 7, 2008

(51) Int. Cl.
*F41B 5/10* (2006.01)

(52) U.S. Cl. ..... 124/25.6; 124/900

(58) Field of Classification Search ..... 124/25.6, 124/900

See application file for complete search history.

(56) References Cited

U.S. PATENT DOCUMENTS 2,872,566 A * 2/1959 Leppala ..... 219/132
3,486,495 A 12/1969 Allen
3,990,425 A 11/1976 Ketchum
4,461,267 A 7/1984 Simonds et al.
4,748,962 A 6/1988 Larson
4,774,927 A 10/1988 Larson
4,967,721 A 11/1990 Larson
4,993,399 A * 2/1991 Chattin ..... 124/25.6
5,535,727 A * 7/1996 Helmuth ..... 124/25.6
5,687,703 A * 11/1997 Vyprachticky ..... 124/25.6
5,791,323 A * 8/1998 Dunlap ..... 124/25.6
6,247,466 B1 * 6/2001 McPherson ..... 124/25.6
6,415,780 B1 7/2002 Proctor
6,763,818 B2 7/2004 Larson
6,990,970 B1 1/2006 Darlington
7,305,979 B1 12/2007 Yehle
7,441,555 B1 10/2008 Larson

* cited by examiner

*Primary Examiner* — John Ricci
(74) *Attorney, Agent, or Firm* — Brian C. Trask

(57) ABSTRACT

Rigging for a compound archery bow including first and second pulley assemblies disposed at ends of opposite first and second bow limbs. Each pulley assembly includes an integral pivot axle, mounted to rotate about an axis at the tip of a limb on which it is mounted. Each pulley assembly also includes a string pulley component fixed to the axle, and having a non-circular peripheral string groove; a cable pulley component fixed to the axle, and having a peripheral cable take-up groove; a bowstring with opposite ends connected to the first and second pulley assemblies such that, at rest condition of the bow, the peripheral string grooves are substantially occupied by wrapped bowstring; a first cable segment, extending from the entry of the peripheral cable take-up groove of the first pulley assembly to an attachment carried by the second limb; and a second cable segment, extending from the entry of the peripheral cable take-up groove of the second pulley assembly to an attachment carried by the first limb.

26 Claims, 3 Drawing Sheets

PULLEY ASSEMBLY AND AXLE FOR COMPOUND BOWS

BACKGROUND OF THE INVENTION

1. Field

This invention relates to compound archery bows. It is particularly directed to an improved pulley assembly for such bows.

2. State of the Art

Compound archery bows commonly carry assemblies of pulley members (usually called "eccentrics" or "cams") eccentrically mounted on axles in association with respective bow limbs. These limbs extend in opposite directions from a grip (usually comprising a central portion of a handle riser). The rigging for compound bows includes a bowstring trained around the pulley members of the system, the string being received by grooves or other functionally equivalent features at the perimeters of the pulleys. The eccentric pulley assemblies are conventionally mounted to rotate (pivot) on an axle within a notch at the distal end of the limb, or within a bracket structure carried by the limb tip. The eccentrics include one or more pivot holes substantially offset from center, whereby to provide for a reduction in the holding force felt at the nocking point of the bowstring, as the string is moved to its fully drawn condition.

Compound bows and various exemplary riggings, including pulley assemblies, are described by U.S. Pat. Nos. 3,486,495; 3,990,425; 4,748,962; 4,774,927; 4,967,721; 6,763,818; and 7,441,555 the disclosures of which are incorporated as a portion of this disclosure.

The rigging for compound bows typically includes cable segments, which may be end stretches extending from an integral bowstring. More often, however, the cable segments are separate elements, each connecting at one end, directly or indirectly, e.g., through structure associated with the pulley assembly, to a terminal end of the bowstring. The remaining (distal) ends of the cable segments are conventionally connected to the opposite bow limb or structure, such as the pivot axle mount of the pulley assembly carried by that limb. In any case, each cable segment includes one or two stretches oriented approximately parallel the bowstring.

"Approximately parallel," is intentionally fluid in context, merely recognizing that the cable segments and bowstring all extend generally across, but out of contact with, the handle riser portion of the bow between the pulley assemblies, or other structure, carried by the respective bow limbs. All of the cable stretches are thus confined within a space defined by reference planes straddling the handle riser and containing the bowstring. The cable stretches are commonly positioned to one side of the bowstring to avoid interference with the nocking point of the bowstring. It is common practice to mount cable guard rods or other structures to the handle riser. These structures are positioned physically to hold the cables away from the plane of travel of the bowstring. Compound bows have sometimes been configured to position cables on opposite sides of a bowstring so that an arrow may be cast in the plane of the bowstring between cable stretches.

With a compound bow oriented in its normal position of use, it is conventional to consider the bow as being oriented vertically. Unless otherwise stated, the bows referred to in this disclosure are assumed to be in this "vertical" orientation. The handle riser is thus considered to have an "upper end," a "lower end" and a central grip portion. The limb extending from the upper end of the handle riser may be referred to as "a first limb" or the "upper limb," in either case terminating in an "upper limb tip." Corresponding terminology is applied to the "second limb," which extends from the lower end of the handle riser. The bowstring is assumed to travel in a plane ("operating plane") of travel between a fully drawn condition and braced or at rest condition. Cable stretches may be viewed as being positioned to the left or right of the plane of travel of the bowstring, recognizing that in some rigging systems, a cable stretch may be to one side of that plane of travel along the first limb and to the opposite side of that plane of travel as the stretch proceeds to its point of attachment at the second limb.

Proper operation of a compound bow typically requires periodic "tuning;" that is, synchronization of the pulley members. The pulley assemblies must be synchronized in their rotation so that the mechanical advantages developed through the two assemblies change at the same rate and to the same degree. Over a period of use, for various reasons, including stretching of the bowstring, compound bows typically migrate out of tuned condition. Re-tuning of the bow requires time consuming and technically demanding adjustments of the rigging. A number of efforts have been made to modify the rigging of compound bows to overcome or reduce the tuning requirement of such bows. These efforts have had little practical success. The persistent need for tuning and re-tuning is believed to be a major impetus for the wide acceptance of single cam bows. Single cam bows are believed by most archers to require much less effort to keep in tune, although the performance of the single cam configuration is less desirable in other respects than is the performance of conventional compound bows.

U.S. Pat. Nos. 3,990,425 and 6,990,870 propose rigging systems that cross-couple the pulley assembles of a compound bow so that they are constrained to move in unison, thereby providing a self-tuning function to the bow. The term "cross-couple" (sometimes "cross-coupling," or "cross-coupled") designates a rigging in which the cable end conventionally attached to the pulley axles are instead attached to a synchronizing sheave of the pulley assembly. To the extent that this expedient has been incorporated into commercial compound bows, the riggings have tended to exacerbate the inherent characteristic of pulley assemblies to twist (or lean) on their axle mounts. The riggings employed to date in cross-coupled bows apply cable force to the limb tips in a fashion that imparts a twisting moment to the mounting axles of the pulley assemblies. The '425 patent discloses pulley assemblies in which cross-coupling is accomplished through an anchoring arrangement that inherently imparts a leaning moment to the pulley assemblies. Specifically, the cables are all disposed to one side of the bowstring. The '870 patent disclosure includes riggings configured to apply cable forces more evenly, thereby reducing the twisting moment applied to the axle of the assembly. Moreover, the '870 patent discloses cross-coupled pulley assemblies within the riggings of single cam compound bows.

Commonly assigned, copending patent application Ser. No. 11/241,030, filed Sep. 30, 2005, the disclosure of which is incorporated by reference, also discloses several alternative embodiments of cross-coupled compound bows.

The conventional practice in constructing compound bows has been to mount all pulley components onto stationary axles. Originally, the pulleys were provided with bushings, rotatably mounted on an axle. More recently, these bushings have been replaced with bearing assemblies of various kinds, Exemplary bearing arrangements for compound bow are described and illustrated by U.S. Pat. No. 6,415,780.

The pulley assemblies in common use currently are typically machined, or otherwise formed, from a common block of material. In some instances pulley components are connected together with pins, bolts or screws. In any case, all of the pulley members of the assembly form a unitary structure mounted to turn upon an axle. The axle may be clamped or otherwise fixed with respect to a limb tip of the bow. In practice, however, operation of the bow is not negatively impacted by minor rotation of the axle with respect to the limb tip, provided the assembly is free to turn upon the axle.

Historically, excessive limb breakage has been associated with the construction practice of positioning an axle directly through channels transverse and within a limb tip of a bow. This problem has been partially alleviated in some constructions by mounting the pulley assembly in a bracket fixed to a limb tip. The use of brackets for this purpose is thought to impact negatively upon bow performance because of the added bracket weight carried by the limb tip under dynamic conditions.

A primary consideration in the design of cam assemblies for a compound bow is the relative configurations of the working portions of the string and cable grooves, respectively. The relationship of these working portions under dynamic conditions has a direct impact upon both the force-draw curve experienced by the archer and the shooting characteristics of the bow upon release of an arrow from drawn condition. It is general practice to wind the strings and cables, respectively, of a rigging such that the tension of the bowstring is opposed by the tension in the cables. During the draw portion of a shooting cycle, the torque applied to a pulley assembly, via the string groove, by the string increases substantially. The opposing torque simultaneously applied by a cable, via a cable groove, to the assembly also increases substantially. These opposing torques are resisted by the relatively massive cross section of the pulley assembly, and are isolated from the pivot axle.

SUMMARY OF THE INVENTION

This invention provides a pulley assembly for compound bows that differs significantly from previous constructions. A notable feature of the assembly is that multiple pulley components are separately fixed to a common axle. The axle is typically structured for journal mounting at its opposite ends in bushing or bearing assemblies carried by a limb tip. As used in this disclosure, the term "journal mounted" refers to a pivot-enabling interconnection of one structural element to another. Most often, that interconnection is effected by a simple bore hole, a bushing or a bearing set (including ball or roller bearings). In this context, a "journal mounted" axle is journalled within one or more fixtures that permit the axle to pivot or rotate around its axis of rotation Such fixtures are sometimes referred to as "journal mounts."

Exemplary journal mounts for the practice of this invention comprise pillow blocks. A pillow block bearing (sometimes called a plummer block) is a mounted bearing assembly used to provide support for a rotating shaft with the mounting surface of the bearing assembly parallel the axis of the shaft. That geometry is considered to be ideal for purposes of this invention. Alternative bearing arrangements, regarded as equivalent to literal pillow block bearings for purposes of this invention, (and which may be regarded as a type of pillow block), mount the bearings in a fixture that extends outboard from the distal end of a bow limb. The fixture may be clamped, or otherwise anchored to the limb.

When drawing an arrow, rotation of the string pulley torques the axle to drive all other components fixed to that axle. The tension of the bow string is opposed by the tension in at least one cable that is wrapped on a cable pulley that is spaced apart from the string pulley and also affixed to the common axle. Therefore, during a release, the cable pulley (or pulleys) may be regarded as applying a torque on the axle effective to drive the string pulley.

Affixing pulley members in spaced apart relation along an axle permits a certain amount of relative motion between pulley members by storing rotational strain energy in the axle. For example, rotation of the cable pulley may tend progressively to lag rotation of the string pulley during the draw portion of a shooting cycle. That is, rotation of the cable pulley will tend to lag the string pulley element(s) responsive to any increase in torque applied to those axially spaced-apart elements during the draw. During the release portion of the shooting cycle, both the string pulley and the cable pulley return to their original "at rest" orientations. The pulley assembly may thus serve as a differential (or smoothing) device by incorporating the axle as an energy storing and distributing element of the assembly.

Embodiments of a cam assembly structured according to certain principles of this invention rely upon a resilient axle structured to react with rotational strain responsive to torque applied to the axle. It is characteristic of compound bow riggings that the force applied to unwind string from a string groove of a pulley assembly is resisted by the force against which cable is simultaneously wound into a cable groove of that assembly. As a practical matter, these opposing forces are insufficient to strain the massive pulley assemblies normally present. That is, pulley assemblies having pulley elements that are integral (either assemblies formed from a single uninterrupted block of material, or having sides of adjacent pulley elements affixed to each other), do not exhibit any significant differential rotational displacement between the individual pulley elements of the assembly. A small amount of strain is induced into the specialized axles contemplated for use in certain embodiments of this invention, however. An additional degree of rotational freedom between pulley elements is present in such embodiments. Upon string release, this induced strain may be recovered by the rigging system, thereby delivering additional energy to a cast arrow.

The pulley assemblies of this invention can be included in any archery device, including traditional compound bows, cross bows and single cam bows. To avoid duplication of description and other redundancies, however, the invention is described in this specification with primary reference to configurations in which pulley assemblies are carried by opposing similar limbs. It is recognized that the pulley assemblies carried by opposing limbs need not be identical (or exact mirror images). In single cam embodiments, for example, the corresponding peripheral groove configurations of opposing pulley assemblies will necessarily differ.

Each assembly includes a string pulley component with a peripheral string groove. The string pulley components of the respective assemblies may be of various cross sectional configuration, but from an operational perspective, are desirably non-circular. They may be mounted concentrically; that is, to pivot around their geometric centers, but are preferably mounted eccentrically; that is, to pivot around respective axes displaced from their geometric centers.

Opposite ends of a bowstring are preferably connected directly to the respective pulley assemblies such that, at rest condition of the bow, the peripheral string grooves are substantially occupied by wrapped bowstring. The term "groove" should be understood to include any structure capable of receiving or otherwise spooling a length of bowstring or cable. The term "bowstring" refers to the flexible line component of the rigging that contains the nocking point and also wraps around the string pulley components of the respective pulley assemblies. It is recognized that, in practice, the portions of the bowstring that wrap around the string pulley components may actually comprise separate cable segments extending from a central string segment containing the nocking point.

A cable pulley component of each respective assembly, having a peripheral cable take-up groove, is disposed approximately parallel to, but spaced apart along their common axle from, the corresponding string pulley. The cable pulley and string pulley are affixed to their common integral axle. The axle is characterized as being "integral" to the pulley assembly because it is structured and arranged to turn in unison with the pulleys of the assembly. The assembly may be formed from a single mass of material (such as by casting or machining). Alternatively, the assembly may be formed from a plurality of components or elements that are fastened together. In any event, each of the cable pulley and a string pulley are affixed to the same axle operably to resist rotation of each respective pulley element about its localized anchoring portion of the axle.

The cable pulley components are desirably mirror images of each other, and may also be of various cross sectional shape, usually non-circular. In practice, preferred pulley assemblies are constructed with non-circular string and cable grooves, the working portions of which may be variably out of radial registration with each other with respect to the axle. A dynamic synchronizing anchor component may also be included in operable association with, typically as a discrete component within, each pulley assembly. The rigging may further include stabilizing means structured and arranged to distribute the application of forces through the cables to opposite sides of the pulley assembly, thereby to reduce to a tolerable magnitude, the increased leaning moment typically applied to the pulley assemblies of compound bows as the bowstring is drawn.

While other configurations are operable, the preferred rigging of this invention includes first and second synchronizing cable segments, each of which includes a first (take-up) end and a second (synchronizing) end. The first synchronizing cable segment is anchored to a first one of the pulley assemblies in position to wrap onto the peripheral cable take-up groove (or functionally equivalent structure) of that assembly. The opposite (synchronizing) end of the first cable segment is anchored to the dynamic synchronizing anchor component of the other pulley assembly. The second synchronizing cable segment is attached to the second pulley assembly in position to wrap into the peripheral cable up-take groove of that assembly. The opposite end of the second cable segment is anchored to the dynamic synchronizing component of the first pulley assembly.

The entire rigging of a currently preferred embodiment is thus constructed and arranged such that as the bowstring is pulled, its opposite ends (or cable segments attached to those ends) unwrap from the rotating peripheral string grooves of the assemblies. Concurrently, the peripheral cable grooves (or functionally equivalent structure) of the assemblies take up (or alternatively, wrap) portions of the first ends of the respective synchronizing cables. According to the presently preferred embodiments of this invention, relatively small lengths of the opposite (synchronizing) ends of the synchronizing cables are released from the synchronizing elements of the respective pulley assemblies as relatively longer lengths of the take-up ends are wrapped onto the cable up-take grooves of the respective opposite pulley assemblies. Of course, these relationships are subject to adjustment as required to obtain preferred force draw characteristics for a particular bow.

The pulley assemblies may be structured with sufficient width to permit passage of a launched arrow between the cables, without the use of a cable guard. In certain embodiments, however, cable-spreading structure is positioned between the cable segments located on opposite sides of the bowstring. Such cable spreading structure may be mounted to extend from the handle riser to between cable stretches located to the right and left of the bowstring. Certain embodiments of the pulley assemblies, particularly those that position all of the cables to one side of the bowstring, are quite narrow, however. Use of a cable guard is generally preferred in those arrangements.

The dynamic synchronizing anchor components of this invention may take various structural forms, provided they perform the function of providing a dynamic connection of a synchronizing cable segment to a pulley assembly. In the context of this disclosure, a "dynamic" connection is one that operates to change the length of the synchronizing cable as the nocking point is drawn, (ignoring the simultaneous change in length effected by wrapping of the take-up end of that cable onto a take-up groove). A typical such dynamic anchor component permits a portion of the cable segment to pay out from (or retrieve into) a pulley assembly as the bowstring is pulled. That is, a preferred synchronizing element is structured to impart a translation, during a portion of the draw of a bowstring, with the translation being directed along the axis of that portion of a cable segment disposed proximal to the limb tip on which the synchronizing element is mounted.

The dynamic anchoring arrangement is in direct contrast to the conventional practice of connecting the terminal end of a cable segment statically to the limb tip opposite the working surface (typically, a cable groove) operably associated with that cable segment. Some such connections comprise a terminal cable loop around the mounting axle of a pulley assembly. While the axle may turn within the loop in some such arrangements, the connection is nevertheless regarded as "static" because the cable segment is not changed in length by virtue of that connection as the bowstring is drawn.

To avoid duplication of explanation, this disclosure focuses on embodiments in which the synchronizing anchor components operate to pay out cable as the bowstring is drawn. It is recognized, however, that these components may alternatively be structured to retrieve cable as the bowstring is drawn. For example, simply reversing the direction of wrap on a spooling surface, results in wrapping rather than unwrapping a synchronizing cable. Either mode of operation effects an operable interaction of the synchronizing cable with the synchronizing component, thereby inherently synchronizing the rotation of the respective pulley assemblies.

While more elaborate structures, including biasing mechanisms indirectly connecting the synchronizing end of a cable segment to the pulley assembly, can be envisioned, a simple small diameter drum, pulley or equivalent spooling member has been found to be adequate in practice to serve as a dynamic anchor. The dynamic anchor pulleys of this invention may comprise an integral portion of its pulley assembly. The spooling surface or groove may be either concentric or eccentric with respect to the mounting axle of the pulley assembly In any case, the working portions of the respective spooling surfaces (or equivalent pay out devices) must be synchronized; that is, release practically identical lengths of synchronizing cable for any drawn distance of the bowstring. The synchronizing end of a synchronizing cable segment may thus be wrapped (wound) around the perimeter of an anchor pulley, or equivalent spooling structure, terminating in an attachment to the pulley assembly itself. Synchronization of the spooling surfaces is less challenging if those surfaces (or grooves) are circular and concentric with respect to the pivot axles of the pulley assemblies. Nevertheless non-circular and/ or non-concentric spooling surfaces may be preferred in certain instances to achieve particular shooting characteristics for a bow.

Unlike the cross coupling arrangement suggested by the '425 patent, the dynamic anchoring system of certain embodiments of this invention is associated with means for redistributing the forces applied to opposite sides of the pulley assemblies at all rest and drawn positions of the bowstring. One such means is to mount duplicate synchronizing anchor components on opposite sides of each pulley assembly. The synchronizing ends of each cable may then be attached through a "Y harness," or equivalent force dividing structure, to both of the duplicate components, thereby evenly distributing the cable tension forces at that end of the cable to opposite sides of the pulley assembly. This arrangement assures that approximately half of the force applied by the synchronizing end of each cable is applied to the pulley assembly at the side of the assembly opposite the string groove from the take-up cable groove.

According to other specific embodiments, duplicating the cable pulley component in similar fashion similarly divides the force applied by the take-up end of the cable. The total force applied by the synchronizing cables is thereby applied approximately evenly to both sides of the pulley assembly, with respect to the string groove.

Alternatively, the working portions of the cable grooves and an opposing anchor spooling groove of the rigging may be arranged with respect to each other and interconnected to ensure that the forces of the synchronizing cables are applied approximately evenly to both the left side and the right side of each pulley assembly. This distribution of forces may be achieved, for example, by positioning two synchronizing cables approximately parallel and on opposite sides of the bowstring, preferably equidistantly spaced from the bowstring, as taught by U.S. Pat. No. 6,763,818 A parallel arrangement of this kind requires that the left-to-right sequence of the upper pulley assembly components be reversed for the lower pulley assembly. This arrangement permits a wide spacing of individual pulley assembly components, and is thus especially suitable for compound bows in which it is intended for an arrow to be launched between the cables.

Another practical embodiment of the invention arranges one synchronizing cable to extend from the cable take-up groove at the left side of a first pulley assembly, across the handle riser of the bow to the anchor spooling surface at the right side of a second pulley assembly. The other synchronizing cable is connected to extend from the cable take-up groove at the right side of the second pulley assembly, across the handle riser of the bow to the anchor spooling surface at the left side of the first pulley assembly. In this construction, each cable crosses the handle riser of the bow in both the vertical and horizontal directions.

In mechanical terms, the bowstring may be regarded as a power source, which acts upon the string pulley components (during the draw portion of a shooting cycle) such that they become prime movers, driving the respective axles. The string pulley components apply torque to the axles, which in turn transmit rotational force to the other pulley components of the assembly. Rotation of the axles is opposed by tension in the cable segments being wound upon the cable grooves. The opposing torques tend to induce strain displacement in the axles. Because the axles are elastic and resilient, they constitute an energy storage means. When the bowstring is released, the induced strain in the axles is also released, thereby contributing to the energy of a cast arrow. Portions of the axles of a rigging between the string pulley components and the cable pulley components may be constructed to strain to a limited degree less than the failure limit of the axles in response to torque of the magnitude developed during the draw portion of a shooting cycle. It is within contemplation to include a resilient device, such as an elastic coupling, in an axle system of the invention. As currently envisioned, opposing torques applied to the axle would be expected to strain resilient components of the device, thereby storing recoverable energy.

In compound bows generally, the working surfaces of the string pulleys and the cable pulleys are typically radially arranged, with respect to the axle, to accomplish a plurality of goals and cooperatively define the shooting characteristics of the bow. A first goal includes applying tension to flex the bow limbs and store as much energy as possible. A second goal includes changing leverage of the string and cables to achieve a desired let-off at full-draw. The first and second goals are mutually conflicting, so a compromise between stored energy and let-off is typically inherent in design of a pulley assembly.

In any case, the instantaneously operating portions (tangent to string or cable) of a pulley's working surfaces are often disposed offset from the axle centerline by a variable radial distance as the pulley assembly is rotated during draw and release of an arrow. Such variable radial distance forms a corresponding variable lever arm with which the cable or string may apply torque on an integral pivot axle through a pulley component.

The tension in a string or cable causes a respective torque on the cable assembly, with the magnitude of the torque being given by the tension multiplied by the minimum radial distance (the lever arm) between the tension vector and the axle centerline. The line of action (tension vector) of the bow string changes significantly in direction during draw and release. Similarly, the line of action (tension vector) of a cable varies during draw and release, although to a lesser extent.

The tension in the cables may be considered as being applied by the bow limbs during release of an arrow. Because the bow limbs are free to move in space during a release, the tension a limb applies to a cable may be characterized by a smooth (continuous) mathematical function, which may even be regarded as a substantially linear function, like a spring. The tension in the bow string during release may be thought of as being applied, at least in part, to the arrow to effect its acceleration. Because the arrow is also free to move in space during a release, the resistance attributable to the arrow may also be characterized by a mathematical function including mass and acceleration of the arrow. However, the tension in the bowstring (related to force imparted to the arrow) is also governed by the complex interactions between cable, string, and pulley working surfaces. Therefore, the force imparted on the arrow may be correspondingly complex.

In grossly simplified terms, rotational acceleration of a pulley assembly is governed by any imbalance between torques (generated by cable tension and string tension acting on respective lever arms) being applied to the rotational inertia of the pulley assembly. Because the respective lever arms defined by cable pulley(s) and string pulley change with rotated position of the pulley assembly, the torque applied to each individual pulley depends upon the instantaneous orientation of the pulley assembly during release of an arrow, among other factors. The changing torques cause fluctuations (increases and decreases) in the rotational acceleration of the pulley assembly. Such changes in rotational acceleration of a pulley assembly are believed to cause corresponding jerk and vibration.

For purpose of this disclosure, jerk is used in the mathematical sense to mean presence of a nonzero derivative of the function defining rotational acceleration. Significant changes in torque between respective pulley elements are believed to be effectively dampened by permitting a small amount of relative rotational motion between the pulley elements about the common axle centerline. By incorporating the axle as a strain energy transmission device, individual pulley elements are permitted a certain freedom to change their rate of acceleration with respect to each other by storing strain energy in the axle. If not stored as strain energy in the axle, an equivalent corresponding amount of energy would otherwise increase jerk and vibration-inducing shock on the rigging. Therefore, a pulley assembly structured according to certain principles of the instant invention is believed to reduce jerk and felt vibration when casting an arrow.

For purpose of this disclosure, the term "bearing system", or sometimes "mounting" or "mountings", is intended broadly to encompass bushings and other known rotational support components, such as roller bearing, or ball bearing elements.

Certain preferred embodiments are supported for rotation about their axle's centerline by a bearing system disposed at opposite ends of the axle (outboard of all pulley elements). The outboard mounting of a preferred bearing system provides widely spaced-apart axle mounts that contribute significant resistance to leaning of a pulley assembly. However, it is within contemplation to provide a substantially equivalent spaced-apart bearing system disposed at one or more location inboard of a pulley member.

One operable inboard mounting arrangement provides cross-coupled cable pulley members disposed outboard of the bearing system (and potentially even the limbs). Such cable pulley members may therefore be spaced apart to facilitate shoot-through, wherein the cables are sufficiently spaced apart from the bow string to permit launching an arrow between the cables, even without a cable spreader.

BRIEF DESCRIPTION OF THE DRAWINGS

In the drawings, which illustrate what are currently considered to be the best modes for carrying out the invention.

DETAILED DESCRIPTION OF THE ILLUSTRATED EMBODIMENTS

Figure 1:
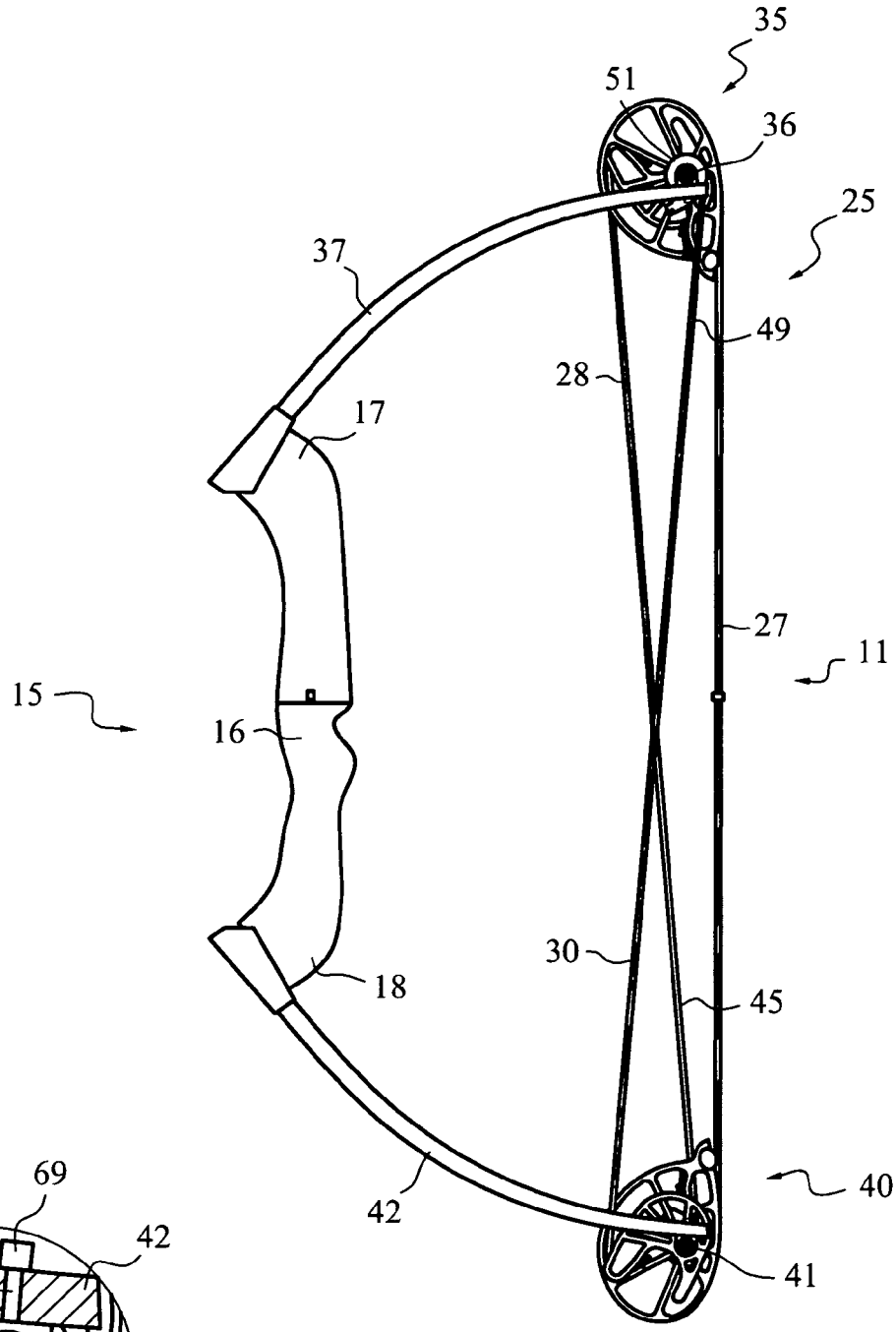
FIG. 1 is a view in side elevation of an archery bow of this invention in "braced" or relaxed condition.

The compound bow, generally 11, illustrated by FIG. 1, is of generally conventional construction. It includes a handle riser component, generally 15, with a grip 16, an upper end 17 and a lower end 18. The rigging, generally 25, includes a bowstring 27, and two synchronizing cables 28, 30. An upper pulley assembly, generally 35, includes an integral pivot axle 36, mounted at the tip of an upper limb 37. A lower pulley assembly, generally 40 similarly includes an integral pivot axle 41 mounted at the tip of a lower limb 42. The rigging 35 is arranged generally as described by copending U.S. patent application Ser. No. 11/241,030, with the synchronizing end 45 of the cable 28 coupled to the pulley assembly 40 through a synchronizing anchor component (not visible). Similarly, the synchronizing end 49 of the cable 30 is coupled to the pulley assembly 35 through a synchronizing anchor component 51. This "cross coupling" configuration, while not required, is a desirable feature for incorporation into the preferred embodiments of this invention. Cross coupling in this fashion provides a self-tuning characteristic to the bow.

Figure 1A:
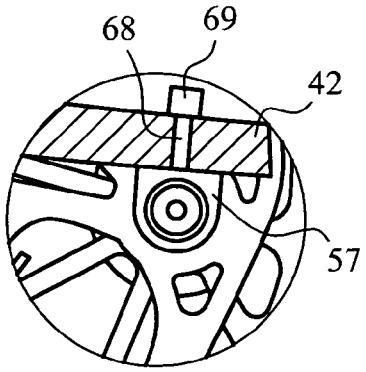
FIG. 1A is a fragmentary view in partial cross-section, to an enlarged scale, taken from the bottom pulley assembly in FIG. 1.
Figure 4:
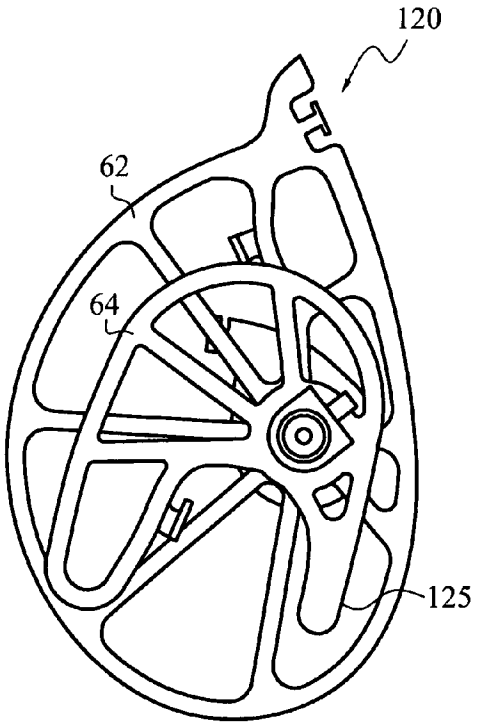
FIG. 4 is a side view of the assembly of FIG. 2, rotated 90 degrees to the right about the same imaginary vertical axis.
Figure 2:
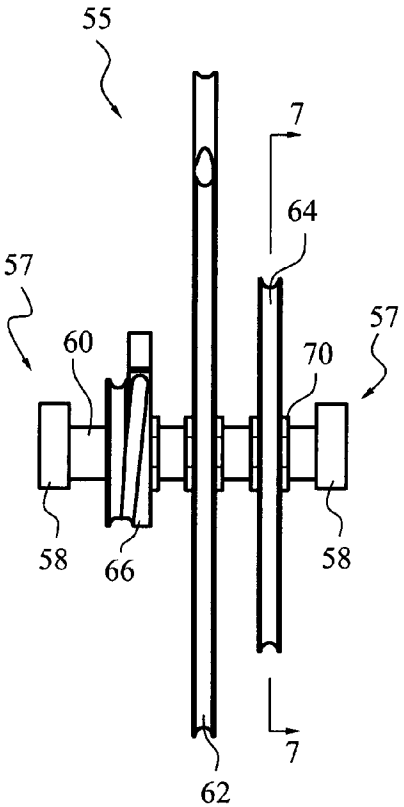
FIG. 2 is a view in front elevation of a pulley assembly structured according to certain principles of this invention.
Figure 3:
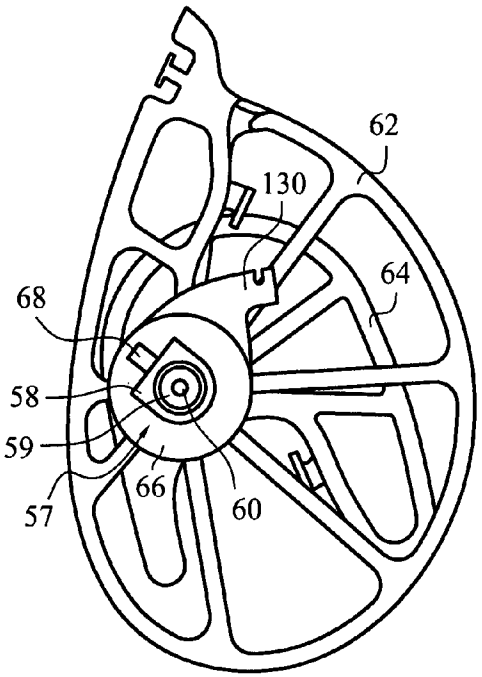
FIG. 3 is a side view of the assembly of FIG. 2, rotated 90 degrees to the left about an imaginary vertical axis.

A presently preferred pulley assembly, generally 55, is illustrated by FIGS. 2 through 4. The mountings, generally 57, are also of a presently preferred construction. The assembly 55 includes an axle 60, to which are affixed a string pulley component 62, a cable pulley component 64 and a synchronizing pulley component 66. The axle 60 may be made integral with the pulley components 62, 64, 66 by machining an assembly from a single block of material, casting, forging, injection molding, or through any other workable construction to form an assembly from discreet components, such as by welding, gluing, swedging, press fitting or by mechanical fastening devices, such as pins or set screws. The illustrated mounting 57 includes an outer housing 58 for a bearing assembly 59, through which the axle 60 is journaled. As best shown by FIG. 1A, a depending peg 68 may be inserted through a limb 42, being held in place with a threaded bolt 69 to anchor the mounting 57 in place. A pair of mountings 57 disposed at opposite ends of the axle 60 (See FIG. 2) provide stable, low friction journal mounting for the illustrated assembly 55.

Figure 7:
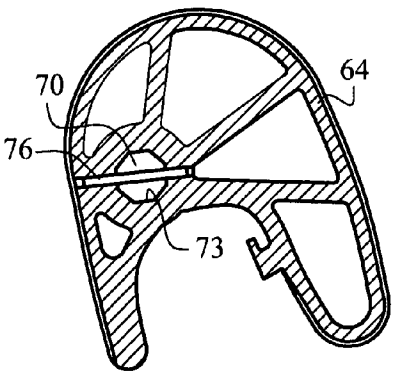
FIG. 7 is a cross sectional view taken along the reference line 7-7 in FIG. 2 and looking in the direction of the arrows.

One practical approach for integrating one or more pulley components to an axle is shown by FIGS. 2 and 7. The portion 70 of the axle 60 extending through the pulley 64 is non-circular, and is dimensioned to register snugly with an opening 73 through the pulley 64. A roll pin 76 holds the pulley 64 against axial movement. With reference to FIG. 2, the ends of the axle 60 may be configured for registration with a central rotating element of a bearing arrangement, such as a ball bearing race disposed in a housing 58.

Figure 6:
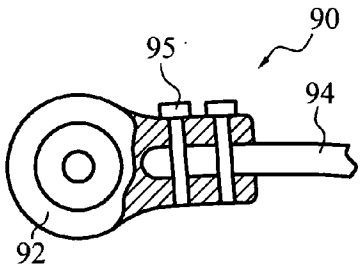
FIG. 6 is a view similar to FIG. 5 of another alternative bearing mounting assembly.
Figure 5:
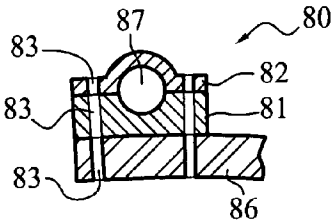
FIG. 5 is a side view in elevation of an alternative bearing mounting assembly.

The bearing assembly illustrated by FIG. 5 is of the type commonly referred to as a "pillow block." A structurally robust outer housing structure, generally 80, includes a base 81 and a cap 82. These elements include extensions with registered bolt holes 83. The housing 80 may be bolted to a limb 86, as shown, to clamp a ball bearing race 87 in mounted position. Alternative versions of the pillow block provide the base 81 and cap 82 as a single element having a bore positioned to receive the ball bearing race 87 (or equivalent bushing or bearing structure). An alternative modified pillow block assembly, generally 90, as illustrated by FIG. 6, includes a rigid (e.g., of metal or hard plastic material) fixture 92 attached to the distal end of a limb 94. Suitable attachment may be by means of integral formation, gluing or mechanical connectors, such as one or more bolt 95.

Mountings may be disposed on opposite sides of a notch in a limb tip, where the notch is adapted to accommodate rotation of one or more pulley elements. In other cases, mountings may be disposed on adjacent limbs of a split-limb bow, effective to dispose at least one pulley element between those split limbs.

Figure 8:
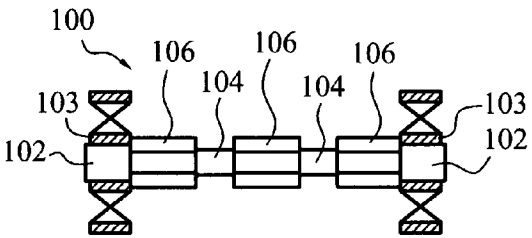
FIG. 8 is a side view of an axle suitable for certain embodiments of the invention.

As shown by FIG. 8, an axle, generally 100, may be constructed with various cross sectional configurations to serve different functions along discrete segments. In the specific instance illustrated, the end segments 102 are configured to snuggly fit into spaced apart bearing races 103. The illustrated strain segments 104 are of reduced diameter selected to strain slightly under opposing torques of the magnitude expected to develop during the draw portion of a shooting cycle. It is within contemplation to form an alternative strain segment having a hollow core and increased diameter (or other shape having a larger characteristic size), adapted to maintain bending stiffness of the axle while enhancing its rotational compliance under torque. The segments 106 have a hexagonal cross section sized to register with cooperatively structured axle passages of individual pulleys.

Figure 9:
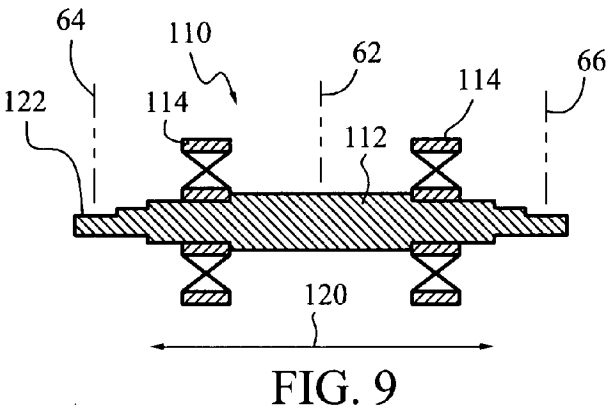
FIG. 9 is a side view of another operable axle.

Another operable axle, generally 110, is illustrated in FIG. 9. A central stretch 112 of axle 110 is structured for its disposition between mountings 114. Central stretch 112 may have any desired cross-sectional shape, although a noncircular shape adapted to form a structural interference with a bore through a string cam is preferred. Furthermore, the cross-section may vary along the length of stretch 112 (e.g. to provide a rotational strain zone), rather than the illustrated substantially constant cross-section.

A string pulley may be installed to rotate with axle 110 in a plane as indicated generally at line 62. A cable pulley 64 and a synchronizer pulley 66 may respectively be affixed to rotate with axle 110 at locations outboard of mountings 114, in planes indicated by their correspondingly numbered lines. In such an arrangement, a bow limb tip may be disposed between the cable pulley and string pulley, e.g. in the zone indicated by arrow 120. The outboard pulleys 64, 66 may be anchored to the axle 110 in several ways, nonexclusively including using a press-fit, roll or dowel pin, or a set screw arrangement. As illustrated, axle 110 includes a flat surface 122, adapted to cause a structural interference with cooperating structure of an axle bore in each outboard pulley member.

Figure 4A:
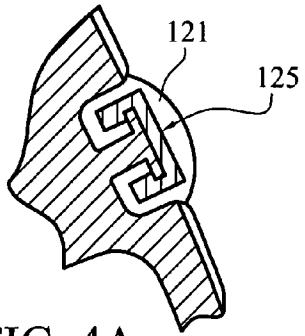
FIG. 4A is a fragmentary perspective view to an enlarged scale, taken from FIG. 4, and including a representative damping element.

The pulley members illustrated by FIGS. 1-4 incorporate a number of advantageous features. A well and post fixture, generally 120 (FIG. 4), is structured to receive and anchor a resilient bumper member 121 (FIG. 4A). This bumper 121 is in contact with the bowstring 27 in braced condition, thereby serving as a string dampener following the launch of an arrow. The peripheral surface 125 comes into rigid contact with a cable 28, 30 at full draw, thereby preventing overdraw or cocking of the bow. A notable characteristic of the illustrated synchronizing pulley 66 (FIG. 3) is its cable attachment extension 130.

What is claimed is:

1. Rigging for a compound archery bow comprising:

first and second pulley assemblies, each including an integral pivot axle, mounted to rotate about respective axes at tips of corresponding first and second limbs of a compound bow; each assembly including:

a string pulley component fixed to said axle, and having a non-circular peripheral string groove; and a cable pulley component fixed to said axle, and having a peripheral cable take-up groove;

a bowstring with opposite ends connected to said first and second pulley assemblies such that, at rest condition of the bow, said peripheral string grooves are substantially occupied by wrapped bowstring;

a first cable segment, extending from the entry of the peripheral cable take-up groove of said first pulley assembly to an attachment carried by said second limb; and a second cable segment, extending from the entry of the peripheral cable take-up groove of said second pulley assembly to an attachment carried by said first limb.

2. Rigging according to claim 1, wherein respective said string pulley components are spaced from respective said cable pulley components on respective said axles.

3. Rigging according to claim 1, wherein said attachments carried by said second and first limbs, respectively, comprise dynamic synchronizing components.

4. Rigging according to claim 3, wherein said dynamic synchronizing components each comprise a spooling surface.

5. Rigging according to claim 1, wherein opposite ends of each of said axles are journal mounted in bearing assemblies carried by respective said limbs.

6. Rigging according to claim 5, wherein respective said string pulley components are spaced from respective said cable pulley components on respective said axles.

7. Rigging according to claim 6, wherein a portion of respective said axles between said string pulley components and said cable pulley components is constructed to strain to a limited degree less than its failure limit in response to torque of the magnitude developed during the draw portion of a shooting cycle.

8. A compound archery bow that includes:

a handle having projecting limbs;

a first pulley assembly, with an integral axle, mounted on a first of said limbs for rotation around a first axis;

a second pulley assembly, with an integral axle, mounted on a second of said limbs for rotation around a second axis; and bow cable means including a bowstring cable extending from bowstring let-out grooves of said first and second pulley assemblies, a first cable extending from a cable take-up groove of said first pulley assembly to second cable let-out means mounted to rotate on said second axis, and a second cable extending from a cable take-up groove of said second pulley assembly to first cable let-out means mounted to turn on said first axis such that draw of said bowstring cable away from said handle lets out bowstring cable from said let-out grooves on said first and second pulley assemblies, rotates said first and second pulley assemblies around said axes, and lets out portions of said first and second cables from said first and second cable let-out means on said first and second pulley assemblies.

9. A compound archery bow according to claim 8, wherein the opposite ends of each of said axles of said first and second pulley assemblies are journal mounted in bearing assemblies carried at the distal ends of respective said limbs.

10. Rigging for a compound archery bow comprising:

first and second pulley assemblies, mounted to pivot on respective axles at tips of corresponding first and second limbs of a compound bow; each assembly including:

a string pulley component with a peripheral string groove;

a cable pulley component with a peripheral cable take-up groove;

an axle fixed to said string pulley and said cable pulley; and a dynamic synchronizing component;

a bowstring with opposite ends connected to said first and second pulley assemblies such that, at rest condition of the bow, the peripheral string grooves are substantially occupied by wrapped bowstring;

a first cable segment, extending from the entry of the peripheral cable take-up groove of said first assembly to said synchronizing component of said second pulley assembly; and a second cable segment, extending from the entry of the peripheral cable take-up groove of said second assembly to said synchronizing component of said first pulley assembly;

said first and second pulley assemblies being structured and arranged such that as said bowstring is pulled from its said rest position towards its drawn position, respective first ends of said first and second cable segments wrap onto the peripheral cable take-up grooves of said first and second pulley assemblies, respectively, and respective second ends of said first and second cable segments operably interact with the dynamic synchronizing components of said second and first pulley assemblies, respectively.

11. Rigging according to claim 10, wherein said peripheral string groove is non-circular in configuration.

12. Rigging according to claim 10, wherein said peripheral cable groove is non-circular in configuration.

13. Rigging according to claim 12, wherein said cable groove is out of registration with said string groove.

14. A pulley assembly for a compound bow including multiple pulley components mounted on an axle, said axle being fixed to said pulley components such that rotation of a pulley component causes rotation of said axle to substantially the same degree; in combination with journal mounts at opposite ends of said axle, said assembly comprising:

a string pulley component with a peripheral string groove;

a cable pulley component with a peripheral take-up groove; and a dynamic synchronizing component.

15. The pulley assembly of claim 14, wherein said dynamic synchronizing component is a pulley with a peripheral spooling surface.

16. The pulley assembly of claim 14, wherein a portion of said axle between said string pulley and said cable pulley is constructed to strain to a limited degree less than its failure limit in response to torque of the magnitude developed during the draw portion of a shooting cycle.

17. The pulley assembly of claim 14, where said journal mounts comprise pillow blocks.

18. Rigging for a compound archery bow comprising:

first and second pulley assemblies, each including an integral pivot axle, mounted to rotate about respective axes at tips of corresponding first and second limbs of a compound bow; each assembly including:

a string pulley component fixed to said axle, and having a non-circular peripheral string groove; and a cable pulley component fixed to said axle, and having a peripheral cable take-up groove;

a bowstring with opposite ends connected to said first and second pulley assemblies such that, at rest condition of the bow, said peripheral string grooves are substantially occupied by wrapped bowstring;

a first cable segment, extending from the entry of the peripheral cable take-up groove of said first pulley assembly to an attachment carried by said second limb; and a second cable segment, extending from the entry of the peripheral cable take-up groove of said second pulley assembly to an attachment carried by said first limb;

said rigging being structured and arranged such that as said bowstring is drawn, rotation of said axles is resisted by cable tension applied to components of said rigging outboard of and spaced from each of said string pulley components.

19. Rigging according to claim 18, arranged such that cable tension is applied to said components on opposites sides of each said string pulley component, whereby to induce strain in said axles on both sides of said string pulley component.

20. Rigging according to claim 18, wherein each of said axles is journal mounted in bearing assemblies carried by respective said limbs and spaced from respective said string pulley components.

21. A pulley assembly for a compound bow, including multiple pulley components mounted on an axle, said axle being fixed to said pulley components such that rotation of a pulley component causes rotation of said axle to substantially the same degree; said axle being associated with journal mounts spaced outboard of and on opposite sides of said pulley components, wherein:

said journal mounts comprise pillow blocks constructed and arranged for attachment to the distal end of a limb tip.

22. Rigging for a compound archery bow, at brace condition the rigging comprising:

a first pulley assembly and a second pulley assembly, each such assembly being carried at a respective tip of first and second limbs of said bow;

said first pulley assembly comprising:

a first axle;

a first string pulley component fixed to said first axle and having a non-circular first peripheral string groove;

a first cable pulley component fixed to said first axle and having a first peripheral cable take-up groove; and a first synchronizing element operably associated with said first axle;

said second pulley assembly comprising:

a second axle;

a second string pulley component fixed to said second axle and having a second peripheral string groove; and a second cable pulley component fixed to said second axle and having a second peripheral cable take-up groove; and a second synchronizing element operably associated with said second axle;

a bowstring with opposite ends connected to said first pulley assembly and said second pulley assembly such that said first peripheral string groove and said second peripheral string groove are substantially occupied by wrapped bowstring;

a first cable segment, extending from said first peripheral cable take-up groove to said second synchronizing element; and a second cable segment, extending from said second peripheral cable take-up groove to said first synchronizing element; wherein:

said first synchronizing element is structured and arranged to cause an effective change in length, during a portion of the draw of said bowstring from said brace condition, of the end of said second cable segment anchored thereto.

23. The rigging according to claim 22, wherein:

said first synchronizing element is structured to impart a translation, during a portion of the draw of said bowstring, said translation being directed along the axis of that portion of said second cable segment disposed proximal to the limb tip on which said first pulley assembly is mounted.

24. The rigging according to claim 22, wherein:

said first string pulley component and said first cable pulley component are disposed for rotation between respective first and second bearing assemblies.

25. The rigging according to claim 22, wherein:

said first synchronizing element is disposed:

outboard of a bearing element in which said axle is journalled for rotation; and on an opposite side of said bearing element from said first string pulley component.

26. The rigging according to claim 22, wherein:

said first synchronizing element is structured and arranged to apply a torque on said first axle acting on a portion of said axle disposed between said first synchronizing element and said first string pulley component.

* * * * *